US005462167A

United States Patent [19]

Polinski et al.

[11] Patent Number: 5,462,167

[45] Date of Patent: Oct. 31, 1995

[54] SPORTS CARD TRAY AND STORAGE ORGANIZER DEVICE

[75] Inventors: Russell E. Polinski, Barrington; John K. Morrow, Arlington Heights, both of Ill.

[73] Assignee: Russell Specialties Corporation, Cary, Ill.

[21] Appl. No.: 20,762

[22] Filed: Feb. 22, 1993

[51] Int. Cl.[6] ..... B65D 85/00

[52] U.S. Cl. ..... 206/455; 206/449; 206/470

[58] Field of Search ..... 206/39, 45.34, 206/449, 455, 457, 470, 472, 473; 40/156, 159, 537, 661

[56] References Cited

U.S. PATENT DOCUMENTS

| | | | |
|---|---|---|---|
| 3,371,439 | 3/1968 | Smith et al. | 40/159 |
| 3,463,309 | 8/1969 | Szostek | 206/470 |
| 4,322,001 | 3/1982 | Hurley | 206/449 |
| 4,524,867 | 6/1985 | Klein et al. | 206/45.34 |
| 4,687,129 | 8/1987 | Cugley | 206/45.34 |
| 4,829,691 | 5/1989 | Manjos et al. | 206/470 |
| 4,944,968 | 7/1990 | Wagner | 40/159 |
| 4,979,619 | 12/1990 | Hager . | |
| 4,984,798 | 1/1991 | Silberstein | 40/156 |
| 5,046,616 | 9/1991 | Makowski et al. | 206/470 |
| 5,097,953 | 3/1992 | Gingras | 206/449 |
| 5,119,574 | 6/1992 | King | 206/470 |
| 5,133,450 | 7/1992 | Rodemacher . | |
| 5,147,041 | 9/1992 | Lemieux et al. . | |
| 5,158,175 | 10/1992 | Crawford . | |
| 5,186,566 | 2/1993 | Cameron | 206/449 |
| 5,190,127 | 3/1993 | Cummings | 40/159 |
| 5,201,525 | 4/1993 | Castro | 40/156 |
| 5,224,600 | 7/1993 | Neugebauer | 206/449 |
| 5,232,094 | 8/1993 | Fagnant et al. | 206/470 |
| 5,307,535 | 5/1994 | Reuter et al. | 206/472 |

*Primary Examiner*—David T. Fidei
*Attorney, Agent, or Firm*—Thomas R. Vigil; James P. Hanrath

[57] ABSTRACT

The sports card tray storage and organizer device comprises a housing having a first card receiving tray section and a second card sorting and device closing tray section. Each tray section is adjacent and hingably connected to the other by a hinge and is movable between (a) a first and second tray end-to-end position for establishing a card access and card sorting tray arrangement and (b) a device closed position with the second tray section received over the first tray section for establishing a card storage assembly. The first tray section has a plurality of card receiving pockets or recesses extending inwardly from an inside surface thereof and the second tray section has a generally planar surface sufficient to cover closely the plurality of card receiving pockets of the first tray section when the second tray section is folded onto the first and latched thereto.

18 Claims, 5 Drawing Sheets

SPORTS CARD TRAY AND STORAGE ORGANIZER DEVICE

BACKGROUND OF THE INVENTION

1. Field of the Invention

The invention relates to a device used in the collecting of memorabilia, and, more particularly, to a sports card tray and storage organizer device for the protection, storage, and organization of collectable cards, specifically sports cards such as baseball, basketball, football, hockey, golf, wrestling, and other cards.

2. Description of the Related Art Including Information Disclosed Under 37 CFR § 1.97–1.99

The collection of cards, particularly sport cards by sports minded individuals, has become a major hobby or advocation throughout the United States and elsewhere in the world. A typical collectable sport card comprises a 2½ inch by 3½ inch cardboard or paper board piece having a face side upon which is printed the picture of a sports athlete, official or personality typically in an action photograph, while the rear side has printed thereon historical data and information or accomplishments about the person such as name, nickname, date and place of birth, career or team history, playing statistics, honors, and other pertinent information, as well as possibly a relaxed photograph of the person.

Whether as a hobby or for investment purposes, there is a considerable interest in collecting sports cards and the manufacture, marketing and trading of such cards has developed into a significant high volume business activity.

Further, individual card collectors and/or traders and the businesses involved in the sports card field have organized clubs, organizations, publications, exhibitions, and conventions to further the interest of sports card collecting and to entice others to participate.

The economic value of sports cards or memorabilia often is dependent, primarily upon, such factors as age, physical condition, and rarity. Service companies are available for providing accurate and consistent appraisals and authentication of sports cards and various memorabilia.

The complexity of sports card and memorabilia collecting and trading and the handling and storage of a multitude of cards by collectors and traders has resulted in the need for unique and functional card collection storage and sorting apparatus and for methods of accomplishing such functions as well as accommodating potentially conflicting goals, such as, to safeguard the sports card or memorabilia so as to preserve their pristine physical condition to thereby command higher prices than otherwise, while allowing access to the cards to allow a person to look at and enjoy the pleasure of the sports card or to obtain autographs of the persons or sports personalities appearing on the card.

Heretofore, soft mylar "envelopes" have been used for the storage of individual cards. These envelopes comprise flexible material. However, they offer little protection from bending and twisting of the enclosed card and provide no effective means of organizing cards in logical sequence as they are capable of accommodating single cards only.

Similarly, soft plastic sheets containing multiple "pockets" each capable of holding a single card have been proposed wherein the sheets are generally punched along one edge to render them mountable in a standard 3-ring binder. However, such a storage system may fail to offer sufficient protection to the card from bending and twisting and still restricts the user to placing one card into one "pocket" which may represent a hinderance to effective organization of the cards.

Another storage device widely available comprises a two-piece, rigid plastic, "clam shell" container wherein a single card is sandwiched between two plastic plates which are snap-fit, one within the other. Such a device offers protection against bending and twisting of the card and prevents the card from being exposed to moisture, dust and ambient air conditions. However, each container is capable of housing only a single card and removal of the card from the container is most difficult, requiring both halves of the "clam shell" to be pried apart. Such containers are more appropriate for a single valuable investment grade of sports card or memorabilia as opposed to other sports cards and memorabilia collected for enjoyment, trading purposes, and aesthetic appreciation.

Examples of a two-piece snap-type fit single card holders are disclosed in U.S. Pat. No. 5,133,450 to Rademacher and U.S. Pat. No. 4,979,619 to Hager.

Another type of storage device, more recently made available, is essentially a variation of a shoe-box storage system wherein cards are stored in a rigid plastic box which may incorporate a hinged lid having a snap close, snap open action. Such a storage device may protect cards against bending and twisting and provide for the storage of multiple cards, a drawback of such device is that retrieval of any one particular card, a series of cards, or a series of related cards, only can be achieved by first removing most, if not all, of the cards.

An example of a generally rectangular container for the storage and protection of sports cards is disclosed in U.S. Pat. No. 5,147,041 to Lemieux et al. The generally rectangular container disclosed therein includes a rigid internal enclosure which is slidably insertable and completely removable from a rigid external enclosure. The external enclosure incorporates two finger grip cutouts located to the front and to either side of the external enclosure to permit grasping the internal enclosure for removal. The internal enclosure has the capacity for storing a plurality of cards and permits random access of such cards by utilizing spaced bottom rails which create a sufficient gap for the insertion of a finger or fingers to raise any specific card or a series of cards, up and out of the card stack. A front panel insert to the internal enclosure is transparent, thus permitting visibility of the first card and any sequential ordering of a stack of cards.

In U.S. Pat. No. 5,158,175 to Crawford there is disclosed a sports card sorter box/tray combination unit and card sorting method wherein the unit includes two mating half-sections which each include five card sorting bins. The sorting bins in the first section are numbered in sequence from 0 to 4 and the sorting bins in the second half-section are numbered in sequence from 5 to 9. With the tray-box unit in an open and card sorting position, the half-sections of the unit are aligned in substantially end-to-end orientation with the bins aligned in numbered sequence from 0 to 9. The card sorting bins of each half-section of the tray-box unit are opened on their upper and inner sides so that the sports cards can be easily slipped into the numbered bins, preferably such that they are stacked in a slightly tilted rearward fashion such that they will not slip out of the bins. The half-sections of the tray-box unit each bear an upper cover and handle portion which cooperate together, when the unit is closed for card carrying and storage purposes, to close the upper sides of the sorting bin and to maintain the enclosed sports cards in stored position therein. A pair of rectangular end or closure wall portions cooperate with end wall portions of the sorter tray and storage box to maintain the card storing half-sections in a closed and abutting arrangement during periods of card storage or transport. The sports card sorter box/tray combination unit is fabricated by the user from cardboard, pasteboard or sheet plastic cut-out pieces having appropriate fold lines and accompanying fabrication directions.

SUMMARY OF THE INVENTION

According to the present invention there is provided a sports card tray storage and organizer device comprising a housing including first and second tray sections, the first tray section being a card receiving tray section and the second tray section being a card sorting and device closing tray section, each tray section being adjacent to and hingably connected to the other by a hinge and being movable between (a) a first and second tray end-to-end position for establishing a card access and card sorting tray arrangement and (b) a device closed position with the second tray received over the first tray for establishing a card storage assembly, the first tray section having a plurality of card receiving pockets or recesses extending inwardly from an inside surface thereof and the second tray section having a generally planar surface sufficient to cover closely the plurality of card receiving pockets or recesses of the card receiving tray section when the second tray section is folded onto the first section, and latching structure for latching the two tray sections together.

Preferably, the sports card tray and storage organizer device has cooperative and symmetrical tray sections which when closed form the shape of a symbol or piece of equipment or emblem or other item associated with a particular sport and the plurality of card receiving recesses of the first card receiving tray section are arranged in a number and order corresponding to the various positions of that particular sport.

The sports card tray and storage organizer device of the present invention advantageously protects cards from bending and twisting, promotes the organization of the cards particularly with respect to positions of the sports involved, and provides a tray and storage container of a shape associated with the sport to which the cards pertain.

BRIEF DESCRIPTION OF THE DRAWINGS

FIG. 6 shows indicia within each of the recessed depending bosses indicating various positions associated with baseball to promote organization of the baseball sport cards.

DESCRIPTION OF THE PREFERRED EMBODIMENTS

Figure 1:
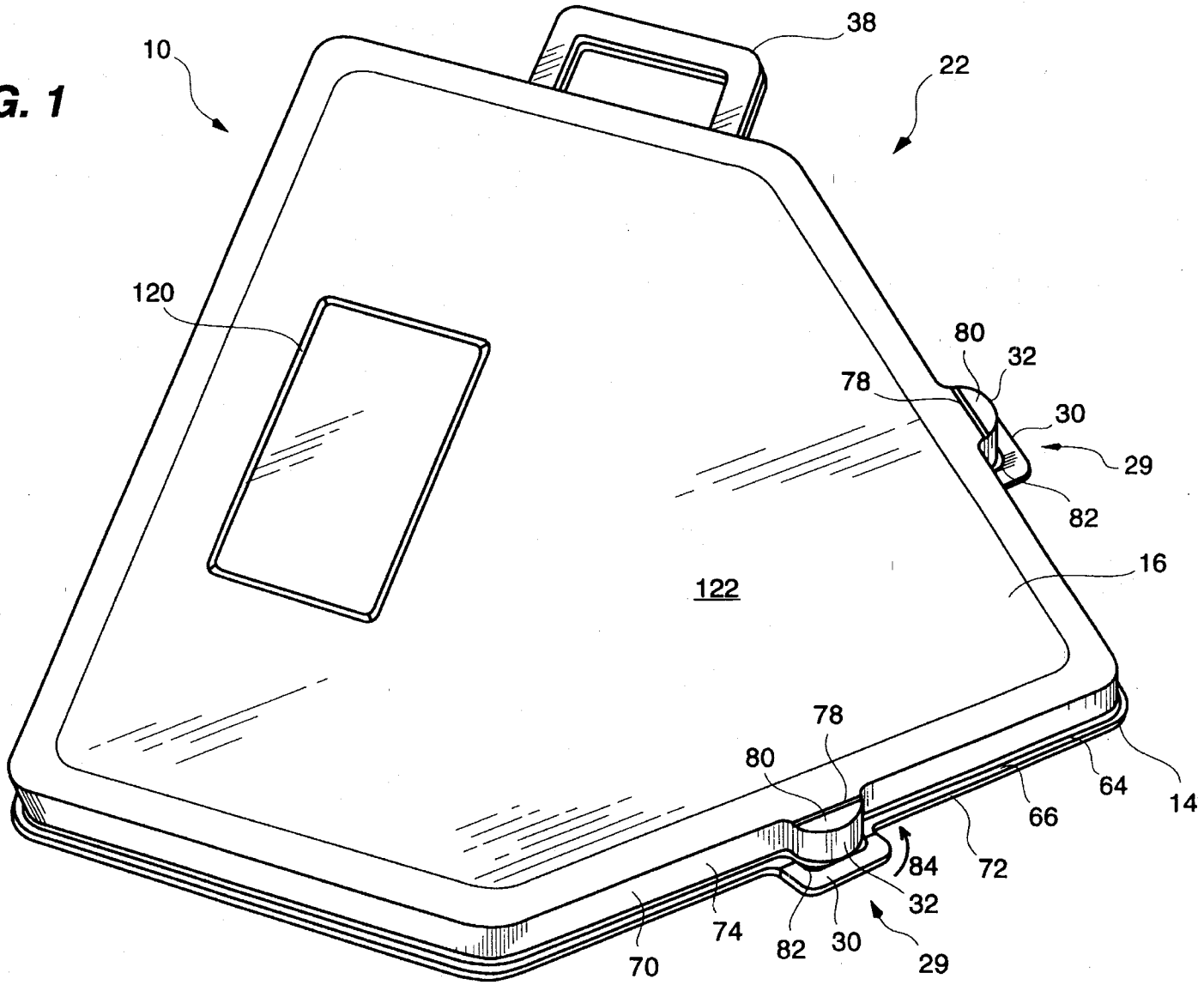
FIG. 1 of the drawings is a top perspective view of a preferred embodiment of the sports card tray and storage organizer device of the present invention shaped in the form of a baseball home plate and shows the tray and storage organizer in a closed position.

Referring now to the drawings in greater detail, there is illustrated in FIG. 1 a top perspective view of a preferred embodiment of a sports card tray and storage organizer device 10 constructed according to the teachings of the present invention. As shown, the device 10 is shaped in the form of a baseball "home plate".

Figure 2:
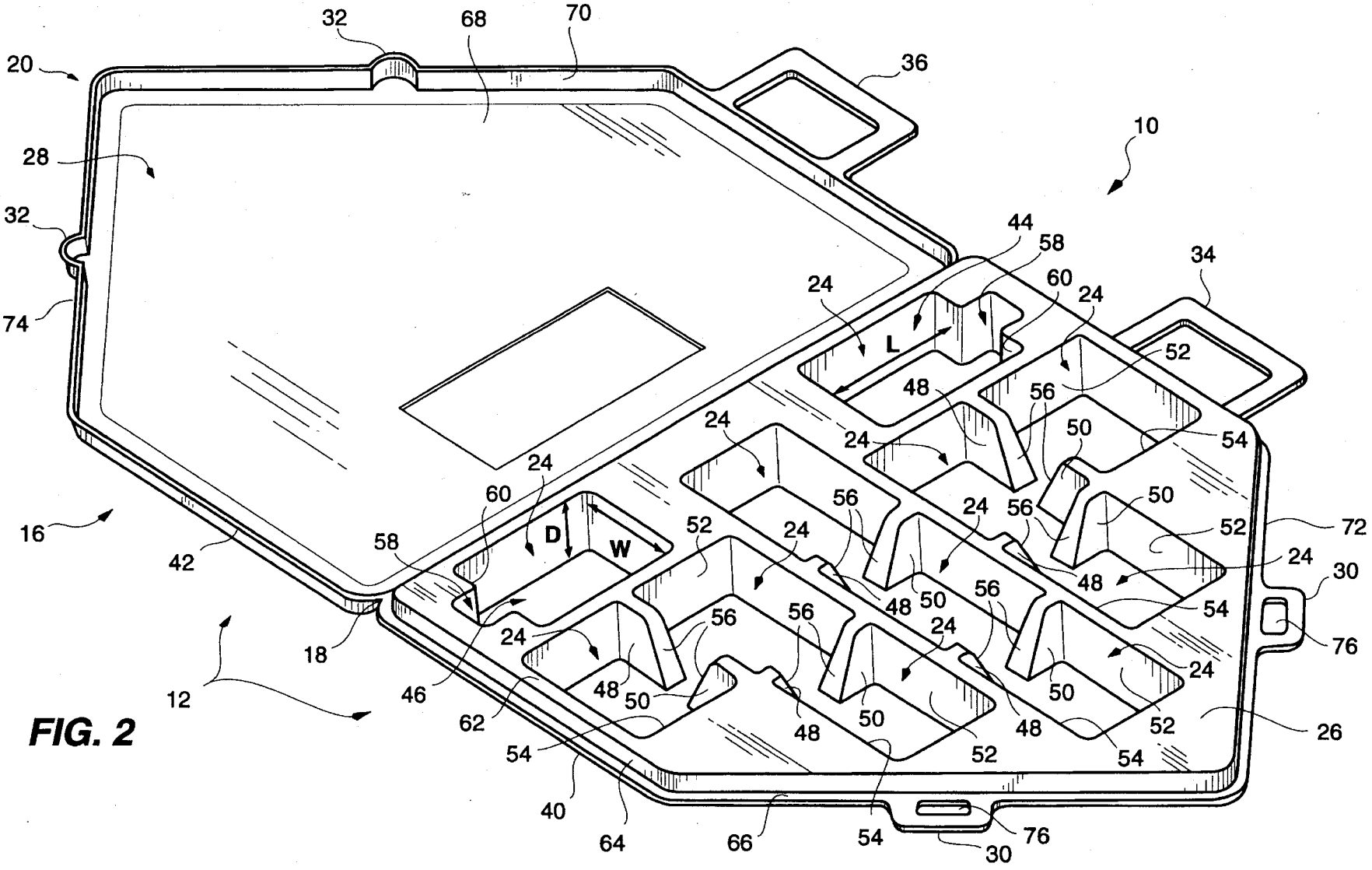
FIG. 2 of the drawings is an upper perspective view of the sports card tray and storage organizer device shown in FIG. 1 and shows the same in an open position where a card enclosing tray section has been opened from a card receiving tray section.

FIG. 2 of the drawings is a top perspective view of the device 10 now showing the device in an open position.

Figure 3A:
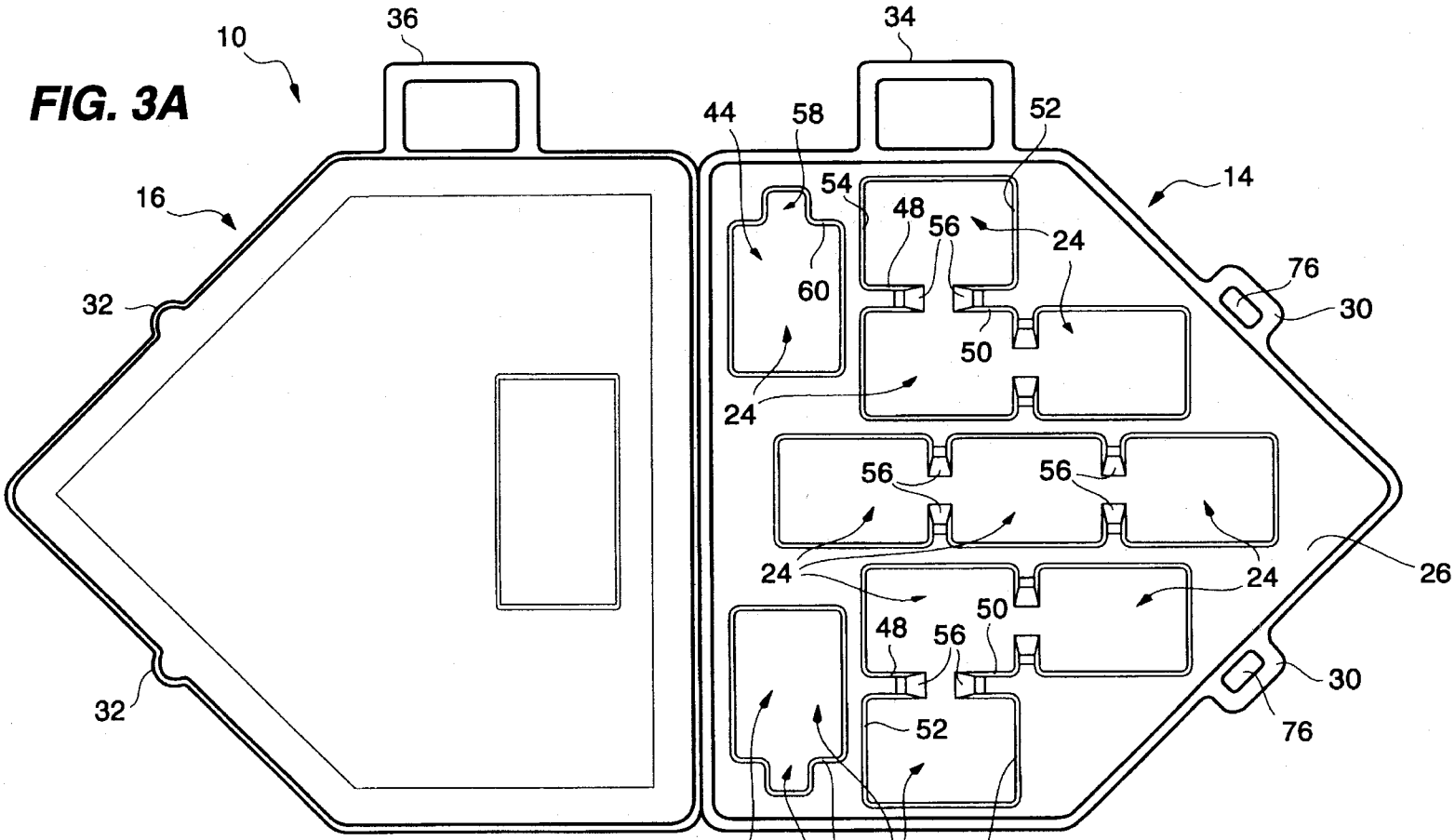
FIG. 3A and FIG. 3B of the drawings illustrates the sports card tray and storage organizer device of FIG. 1 and shows at FIG. 3A a top plan view of the device and at FIG. 3B a side plan view of the device.
Figure 3B:
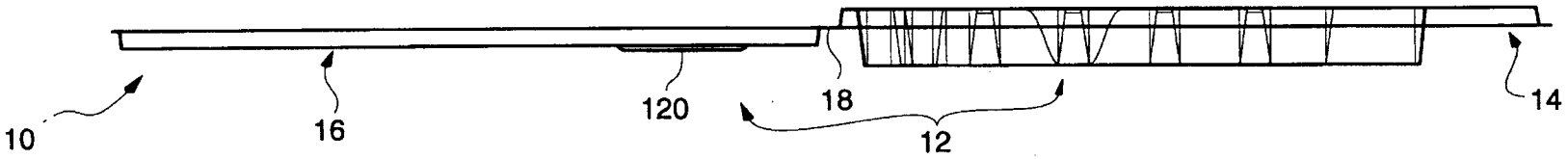

As shown in FIG. 2 and the side plan view shown in FIG. 3B, the device 10 comprises a housing 12 which includes a first tray section 14 and a second tray section 16 connected together by a living hinge 18. The first tray section 14 is a card receiving tray section while the second tray section 16 is a card sorting and device closing tray section.

The first tray section 14 and the second tray section 16 are each adjacent to and hingably connected to the other by the living hinge 18 and therefore are movable between (a) a first and second tray end-to-end position (the open position as illustrated in FIG. 2) for establishing a card access and card sorting tray arrangement 20 and (b) a device 10 closed position where the second tray section 16 is received over or encloses the first tray section 14 for establishing a card forward assembly 22 shown in FIG. 1.

The first tray section 14 has a plurality of card receiving pockets or recesses 24 extending inwardly from an inside surface 26 of the first tray section 14. The plurality of pockets or recesses 24 are constructed to be just slightly larger than a sports or collectible card to be inserted therein so as to correlate with card manufacturing tolerances which, typically, are plus or minus 0.050 interest. Thus, for most sports or collectible cards manufactured from 1957 to present, having dimensions specified to be 2½ inches by 3½ inches, the plurality recesses 24, constructed according to the present invention, can be constructed with a width W, which preferably is at least 2.550 inches, a length L, which is preferably at least 3.570 inches, and a depth D of approximately 1.5 inches, to accommodate numerous cards therein.

The second tray section 16 has a generally planar inside surface 28 sufficient to cover closely the plurality of card receiving pockets or recesses 24 of the card receiving tray section 14 when the second tray section 16 is folded onto the first tray section 14.

At least one latching structure 29 is provided for latching the two tray sections 14 and 16 together and may in part comprise a protrusion member 30 cooperative with a second protrusion member 32 in a manner as will be described hereinafter. Handles 34 and 36 to each of the tray sections 14 and 16, respectively, register with each other when the tray sections are folded together to form a unitary handle 38 when device 10 is in a closed position, as shown in FIG. 1.

As illustrated in FIG. 1 and FIG. 2, the first and second tray sections 14 and 16 are substantially symmetrical in their shape at their outer edges 40 and 42, respectively. When the pair of tray sections 14 and 16 are closed as illustrated in FIG. 1, they form the shape of a symbol or piece of equipment or emblem or other item associated with a particular sport such as, for example, device 10 being shaped as a "Home Plate" used in a baseball game.

It will be understood that the symmetrical shape of then tray sections 14 and 16 can be altered to form the shape of a symbol or piece of equipment or emblem or other item associated with another sport such as basketball, football, hockey, golf, wrestling, tennis, soccer, or other sport.

Similarly, the plurality of card receiving recesses 24 are preferably arranged in a number and/or order corresponding to the various positions of the particular sport for which the sports card tray storage and organizer device is associated.

Figure 4:
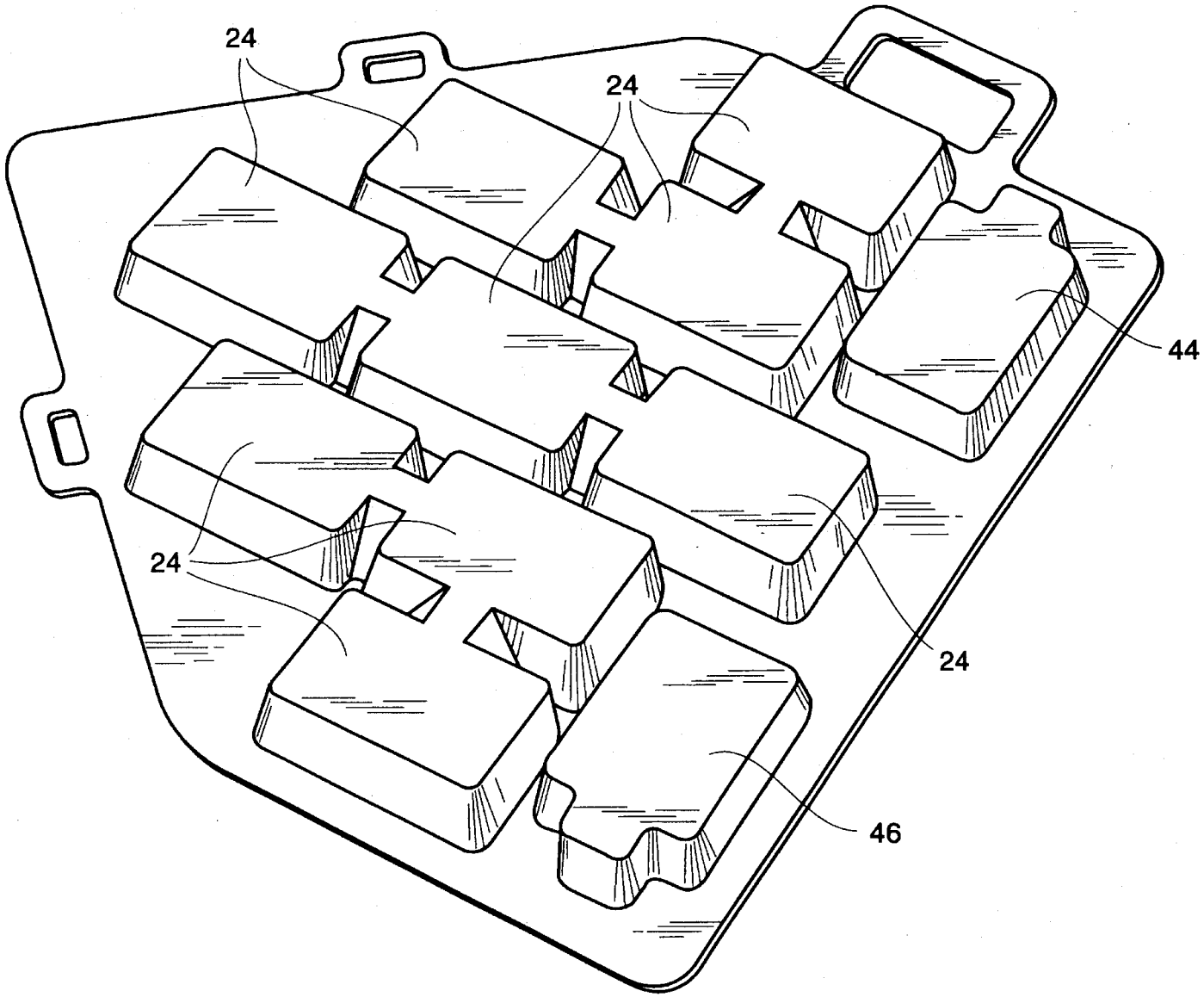
FIG. 4 of the drawings is a lower perspective view of the card receiving tray section of the sports card tray and storage organizer device shown in FIG. 1.

For example, as shown in FIG. 2 or in the bottom view of FIG. 4, the device 10 includes in the first tray section 14 eleven card receiving pockets or recesses 24 extending inwardly from the inside surface 26 thereof, nine of which correspond to the nine baseball fielding positions and two extra recesses 44 and 46 of which may be used for storage of "bullpen" baseball pitcher sports cards or "designated hitters" or "teams" or "managers" or other special sports cards associated with baseball. Each card receiving pocket or recess 24 is approximately 1½ inches deep to accommodate numerous baseball card therein.

As shown in FIG. 2 or in the top plan view of FIG. 3A, one or more of the card receiving pockets 24 of the first tray section 14 can include opposed ribs 48 and 50 which protrude outwardly from opposed side walls 52 and 54 of the pocket 24 to provide a divider formation between side walls of some of the card receiving pockets. The opposed ribs 48 and 50 preferably have a tapered front facing surface 56 to allow access by the finger of a user of cards stored in some of the card receiving pockets 24. Alternatively, as illustrated in pockets 44 and 46, an access groove 58 extending inwardly from a side wall 60 of the pocket 44 or 46 may be provided with sufficient dimension to allow a finger of a user to gain access to cards stored in the pockets 44 and 46.

Referring to FIG. 2, the device 10 preferably is constructed such that the first tray section 14 includes a raised planar inner surface 62 with the plurality of card receiving recesses or pockets 24 depressed therefrom and a side edge 64 extending from the raised planar surface to a lower flange 66.

The second tray section 16 of the device 10 is preferably constructed to include a depressed planar surface 68 bordered by an upstanding rim 70. When the second tray section 16 is closed upon the first tray section 14 of the device 10 as shown in FIG. 1, the upstanding rim 70 of the second tray section 16 is received adjacent the side edge 64 of the first tray section 14. In this closed position, the rim 70 of the second tray section 16 preferably frictionally engages the side edge 64 of the first tray section 14, the frictional fit defining at least part of the latching structure 29.

In addition to the frictional fit described above, and as illustrated in FIGS. 1, 3A and 3B, the latching structure 29 of the device 10 may at least, in part, include at least one protrusion member 30 located at the first tray section outer side surface 72 (or second tray section outer side surface 74) which cooperates with at least one second protrusion member 32 at the other outer side surface of the second tray section 16 or the first tray section 14 when the second tray section 16 is folded over the first tray section 14.

The first protrusion member 30 preferably has a hole 76 and also is adapted to receive the second protrusion member 32 in the hole 76 in a snap-fit arrangement. Further, as illustrated in FIG. 1, the second protrusion member 32 can include a groove 78 at its upper outer surface 80 which is capable of receiving a seating edge 82 of the protrusion member 30 which seating edge 82, in part, defines hole 76.

As shown in FIG. 1 or in FIG. 2, the rim 70 of the second tray section 16 is received adjacent the side edge 64 of the first tray section 14 with the rim 70 of the second tray section 16 being received upon or disposed above the lower flange 66 of the first tray section 14 such that a frictional fit is established therebetween and defines at least part of the latching structure 29.

As illustrated in FIGS. 1 and 2, the flange 66 of the first tray section 14 has at least one portion, such as the protrusion member 30 having the hole 76 therein, and the rim 70 of the second tray section 16 has at least one protruding portion, such as the second protrusion member 32 which is adapted to be received in the hole 76 of the flange 66 in a snap-fitting manner, thereby forming at least part of the latching structure.

Further, the flange 66 having the hole 76 therein may be foldable upwardly as shown by the arrow 84 in FIG. 1, such that a seating edge 82 of the flange 66, which in part defines the hole 76, can be captured in a groove 78 in the upper outer surface 80 of the rim 70.

As previously described, the plurality of card receiving pockets or recesses 24 of the first tray section 14 may be arranged in a number and/or order corresponding to the various positions of a particular sport to which the sports card tray storage and organizer device is associated.

Printed indicia indicative of the various positions of a particular sport may be placed in, on or adjacent the plurality of card receiving pockets or recesses 24.

Figure 5:
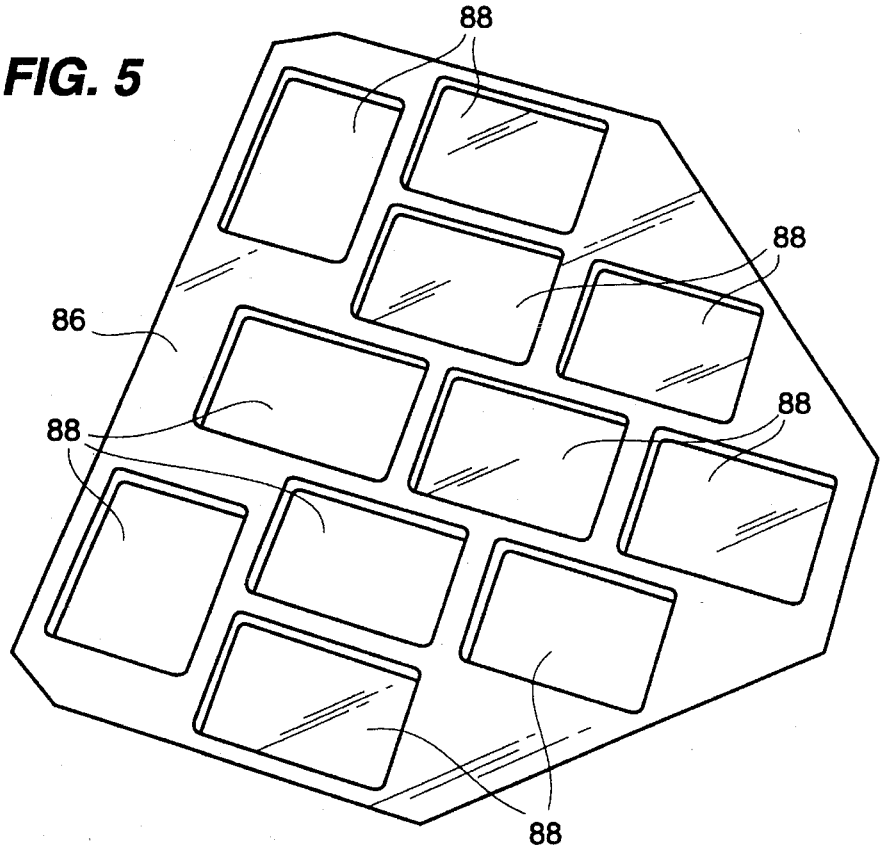
FIG. 5 of the drawings is a top perspective view of an overlay for the card receiving tray section of the sports card tray and storage organizer device shown in FIG. 1 and shows the overlay having recess depending bosses complementary to the pockets of the card receiving tray section.

Alternatively and preferably, as illustrated in a top perspective view shown in FIG. 5, an overlay sheet 86 of the sports card tray and storage organizer device 10 may be provided for placement upon the inner surface 26 of the first card receiving tray section 14.

Figure 6A:
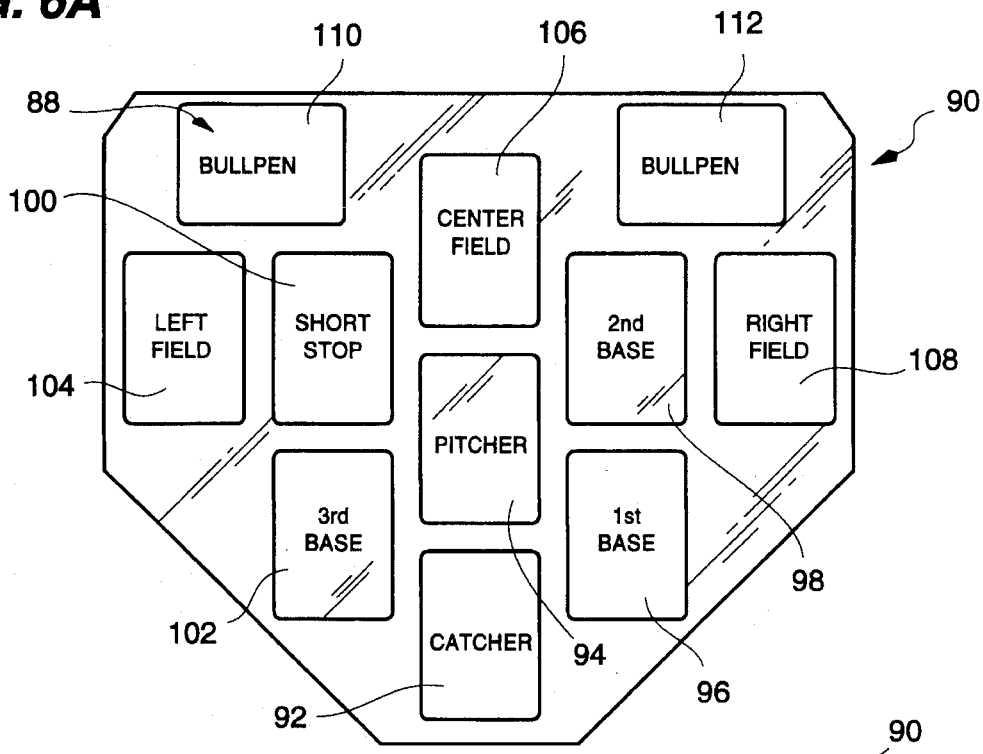
FIG. 6 of the drawings is a top plan view of the overlay sheet for the card receiving tray section of the sports card tray and storage organizer device shown in FIG. 1. Unlike FIG. 5.
Figure 6B:
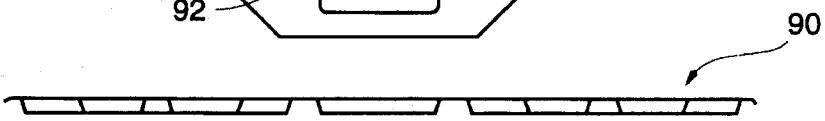

FIG. 6 is a top plan view of an alternative overlay sheet 90 for the card receiving tray section 14 of a sports card tray and storage organizer shown in FIGS. 1 or 2.

However, unlike FIG. 5, FIG. 6 shows printed indicia on each of the recessed depending bosses 88 indicating various positions associated with baseball to promote organization of baseball sports cards. Specifically, the nine fielding positions of baseball are arranged in a number and position associated with such positions, namely the boss 92 showing indicia of the catcher position, the boss 94 showing indicia of the pitcher position, the boss 96 showing indicia of the first base position, the boss 98 showing indicia of the second base position, the boss 100 showing indicia of the short stop position, the boss 102 showing indicia of the third base position, the boss 104 showing indicia of the left field position, the boss 106 showing indicia of the center field position, and the boss 108 showing indicia of the right field position. Two additional bosses 110 and 112 with indicia designating "Bullpen" may be used to store relief pitchers, designated hitters, managers, team, or other cards associated with baseball. The overlay sheet 90 is placed on the inside surface 26 of the first tray section 14 of the device 10.

The sports card device 10 of the present invention preferably has its first and tray sections 14 and 16 and the living hinge 18 integrally molded as one piece from a plastic material. The overlay sheet 90 is preferably made of a mylar material. Also, an upstanding rectangular rib 120 for locating placement of a decal can be provided on an outer surface 122 of the tray section 16 as shown in FIGS. 1.

Although various embodiments of the present invention have been described herein, it is to be understood that modifications and substitutions, as well as rearrangements and combinations of the described embodiment(s) can be made to the device 10 by those skilled in the art without departing from the teachings of this invention. Accordingly, the scope of the invention is only to be limited as necessitated by the accompanying claims.

We claim:

1. A sports card tray storage and organizer device comprising a housing designed to receive sports card and including first and second tray sections, said first tray section being a card receiving tray section and said second tray section being a card sorting and device closing tray section, each tray section being adjacent to and hingedly connected to the other by a living hinge and being movable between (a) a first position where said first tray section and said second tray section are in a tray section end-to-end position for establishing a card access and card sorting tray arrangement and (b) a second, device closed position with said second tray section received over said first tray section for establishing a card storage assembly, said first tray section having a plurality of card receiving pockets or recesses extending inwardly from an inside surface thereof and said second tray section having a generally planar surface sufficient to cover closely said plurality of card receiving pockets or recesses of said card receiving tray section when said second tray section is folded onto said first tray section, and latching means for latching said two tray sections together, said first and second tray sections, when closed and latched together, forming the shape of at least one of: a symbol associated with a particular sport, a piece of equipment associated with a particular sport, or an emblem associated with a particular sport.

2. The sports card device of claim 1 wherein the pair of tray sections are substantially symmetrical in shape at their outer edges.

3. The sports card device of claim 1 wherein said device has the shape of a "Home Plate", i.e. a rectangle with a triangle on one side, used in a baseball game and said device is used to store baseball cards.

4. The sports card device of claim 1 wherein said plurality of card receiving pockets or recesses of said first card receiving tray section are arranged in a number order corresponding to the various positions of a particular sport.

5. The sports card device of claim 4 wherein said first card tray section has, on, in or adjacent said plurality of card receiving recesses, printed indicia indicative of the various positions of a particular sport.

6. The sports card device of claim 1 further including an overlay sheet for placement on the inside surface of said first tray section, said overlay sheet having recessed depending bosses formed therein complementary to said card receiving pockets or recesses.

7. The sports card device of claim 6 wherein said overlay sheet further includes printed indicia located to be associated with respective ones of said pockets or recesses indicative of the various positions of a particular sport.

8. The sports card device of claim 1 wherein one or more of said plurality of card receiving pockets or recesses further includes opposed ribs which protrude outwardly from opposite side walls of the recess and which serve as a divider between portions of some of said card receiving recesses to form closely adjacent card receiving pockets.

9. The sports card device of claim 1 wherein one or more of said plurality of card receiving pockets or recesses further includes an access groove which extends inwardly of a side wall of the recess and which is of sufficient dimension to allow a finger of a user to gain access to cards stored in said recess.

10. The sports card device of claim 1 wherein said latching means includes at least one protrusion member at an outer side surface of one of said first and second tray sections cooperative with at least one second protrusion member at an outer side surface of the other of said first and second card tray sections when said second tray section is folded over and onto said first tray section.

11. The sports card device of claim 10 wherein at least one of said protrusion members has a hole therein for receiving said other protrusion member.

12. The sports card device of claim 11 wherein said second protrusion member further includes a groove capable of receiving an edge of said first protrusion member which in part defines said hole.

13. The sports card device of claim 1 wherein said first tray section includes a raised planar inner surface with said recesses or pockets depressed therefrom and a side edge extending from the raised planar surface to a lower flange and said second tray section includes a depressed planar surface and an upstanding rim, and when said tray sections of said device are in said closed position, said rim of said second tray section is received adjacent said side edge of said first tray section.

14. The sports card device of claim 13 wherein said rim frictionally engages said side edge and said frictional fit therebetween defines at least part of said latching means.

15. The sports card device of claim 1 wherein said flange has at least one portion with a hole therein and said rim has at least one protruding portion which is adapted to be received in said hole in a snap-fitting manner, thereby forming at least part of said latching means.

16. The sports card device of claim 15 wherein said rim protruding portion has a groove which is capable of receiving an edge of said flange portion and which, in part, defines said hole.

17. The sports card device of claim 1 further including a handle at an outer side surface of one or both of said tray sections.

18. The sports card device of claim 1 wherein said first and second tray sections and said living hinge are integrally molded as one piece from a plastic material.

* * * * *